United States Patent [19]

Skolek

[11] Patent Number: 4,484,414

[45] Date of Patent: Nov. 27, 1984

[54] SHAFT GRINDING GAGE

[76] Inventor: Thomas A. Skolek, Kosciusko Rd., R.D. #1, Whitehouse Station, N.J. 08889

[21] Appl. No.: 386,716

[22] Filed: Jun. 9, 1982

[51] Int. Cl.[3] ..... B24B 49/00

[52] U.S. Cl. ..... 51/165.75; 51/289 R; 33/185 R

[58] Field of Search ..... 51/165 R, 165.74, 165.75, 51/165.76, 289 R; 33/185 R

[56] References Cited

U.S. PATENT DOCUMENTS

| | | | |
|---|---|---|---|
| 1,225,858 | 5/1917 | Raule | 51/165.76 |
| 1,664,823 | 4/1928 | Knowles | 51/165.75 |
| 1,843,300 | 2/1932 | Player | 51/165.75 |
| 2,237,496 | 4/1941 | Muskovin | 51/165.75 |
| 2,277,028 | 3/1942 | Widener | 51/165.75 |
| 2,879,599 | 3/1959 | Masinda | 51/165 R |
| 3,352,022 | 11/1967 | Fish | 51/165.74 |
| 3,568,372 | 3/1971 | Asano | 51/165 R |

OTHER PUBLICATIONS

Norton Company, publication dated May 25, 1939, "Direct Indicating Table Stop".

*Primary Examiner*—Harold D. Whitehead
*Attorney, Agent, or Firm*—Horst M. Kasper

[57] ABSTRACT

A grinding gage assembly for grinding of shafts at machines providing a stationary support of the axis of the rotating shaft and a movable support for the rotating grinding wheel. A block is attached to the stationary support of the shaft axis. An angle transfer lever has two arms running at an about 90 degree angle from a hinge axis and the end of one of the arms contacts the block in an about tangential direction relative to the hinge point. The hinge axis is about vertical to the direction of motion of the movable support. A motion transmitting rod is disposed at the movable support in a vertical direction and contacts with one end in its longitudinal moving direction the second arm of the angle transfer lever in tangential direction such that the angle transfer lever transmits any relative motion of the block onto the motion transmitting rod. A dial indicator engages the second end of the motion transmitting rod to display the relative change in position of the motion transmitting rod.

12 Claims, 4 Drawing Figures

SHAFT GRINDING GAGE

DESCRIPTION

Background of the Invention

1. Field of the Invention

The present invention relates to a grinding gage assembly for grinding shafts at machines having a stationary support for the axis of the rotating shaft and a movable support for a rotating grinding wheel.

2. Brief Description of the Background of the Invention Including Prior Art

Grinding and regrinding machines for shafts and in particular crankshafts for internal combustion engines comprise in general a stationary base supporting the rotation axis of the shaft to be ground or reground and a movable support for the rotating grinding wheel forming the headstock. The moving support can be moved so as to advance and retract the grinding wheel versus the shaft as the grinding process proceeds. Extreme tolerances are frequently required to be met in grinding such shafts so that the large forces acting on crankshafts of internal combustion engines during operation are properly balanced.

In order to properly grind such shafts in particular with machines exhibiting some wear it is necessary to follow closely the advancing of the grinding process. P. S. Arnold in U.S. Pat. No. 3,386,178 discloses what has become known as the "Arnold-gage". This gage includes a frame element adapted for pivotal mounting to the grinding machine and carrying one of the two contact points necessary for determining the diameter of the work piece. A plunger element is slidably mounted relative to the frame element and is provided with the other contact point in engagement with the work piece. A disadvantage of this gage is that it determines the diameter of the shaft only after it has been ground off and therefor it easily occurs that more is taken off the shaft than is intended, since this measurement is post facto after the grinding.

Meyer et al. in U.S. Pat. No. 3,942,895 teach a linear digital readout assembly for milling machines and the like and means for mounting the same, but they do not show a simple gage adapted to shaft grinding. Lendi et al. in U.S. Pat. No. 4,126,940 teach an adjustable fork gage. Meyer in U.S. Pat. No. 4,265,026 teaches an internal measuring device. Walther in German Pat. No. 640,028 teaches a measurement device for tool machines and in particular for drilling machines so as to determine the depth of a bore hole. A. Eisele in U.S. Pat. No. 3,086,292 teaches a surface separation measuring gage. These and other devices provide length measurements, but they do not provide a teaching suitable to meet he exacting requirements encountered in shaft grinding in a simple way.

SUMMARY OF THE INVENTION

Purposes of the Invention

It is an object of the present invention to provide a grinding gage of simple construction suitable for shaft grinding machines.

It is another object of the present invention to provide a grinding gage which allows to determine the advance of the grinding process during the operation.

It is a further object of the invention to provide a method by which crankshafts of internal combustion engines can be reground to a high degree of accuracy at conventional machines without unusual attention by the operator.

These and other objects and advantages of the present invention will become evident from the description which follows.

Brief Description of the Invention

The present invention provides a grinding gage assembly for grinding of shafts at machines having a stationary support for the rotating shaft and a movable support for the rotating grinding wheel. An angle transfer lever mounted to the movable support has two arms running at about a 90 degree angle from a hinge axis and the end of one of the arms contacts in an about tangential direction relative to the hinge point a block attached to the stationary support of the axis. The hinge axis is disposed about vertical to the direction of motion of the movable support. A motion transmitting rod is disposed at a guide holder at the movable support in a vertical direction and contacts with one end in the moving longitudinal direction of the rod the second arm of the angle transfer lever in about tangential direction relative to the hinge point such that the angle transfer lever transmits any relative motion of the block onto the motion transmitting rod. A dial indicator engages the second end of the motion transmitting rod for displaying the relative changes in position of the motion transmitting rod.

A spring can be attached to the motion transmitting rod for pressing the rod's end firmly against the second arm of the angle transfer lever. The block can comprise a shaft which provides the contact to the one arm of the angle transfer lever as well as a support for setting the relative position of the shaft. Preferably, a set screw sets the position of the shaft. In addition, a disk can be provided surrounding the shaft, a stop can be attached to the shaft for limiting the motion of the shaft relative to the disk, an air cylinder can be attached to the stationary support and can be attached to the disk for moving the disk, and the cylinder can have a connection to a compressed air supply. A veneer cable of Bowden cable can be connected to the shaft for adjusting the position of the shaft. A helical spring can be attached to the shaft for maintaining the same in position versus the one arm of the angle transfer lever. A switch can be associated with the angle transfer lever for discontinuing the motion of the movable support. The one arm of the angle transfer lever can have half the length of the second arm of the angle transfer lever so that the dial indicator reads the changes in diameter of the crank shaft during grinding rather than the change of the radius.

There is also provided a method for controlling the grinding of a shaft having a stationary rotation axis with a grinding wheel having a movable support. A block attached to the stationary support for the stationary rotation axis contacts a first arm of an angle transfer lever having its hinge axis attached to the movable support and said hinge axis is disposed vertical to the direction of motion of the movable support. A motion of the angle transfer lever is induced by providing a motion of the movable support as the ange transfer lever arm is pressed by a spring force against the block. A motion transmitting rod mounted on the movable support is engaged with a second arm of the angle transfer lever for transmitting the relative motion of the lever around the hinge induced by the motion of the movable support. The displacement caused by the motion of the transmitting rod is displayed on an indicator dial.

The position of a part of the block to contact the one arm of the angle transfer lever can be adjustable. The reference position of the dial indicator can be set by adjusting the position of the part of the block contacting the angle transfer lever with an air pressure cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing in which are shown several of the various possible embodiments of the present invention.

Like reference numerals in the above drawing designate like elements.

DESCRIPTION OF INVENTION AND PREFERRED EMBODIMENTS

Figure 1:
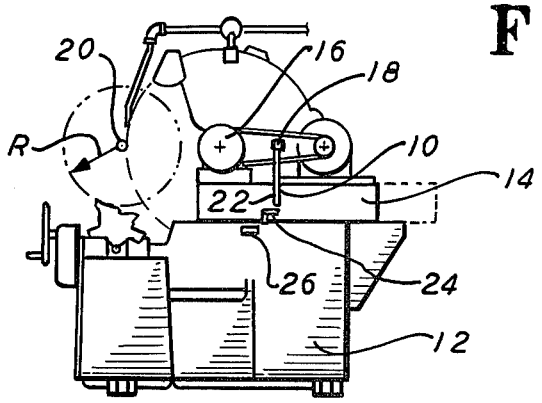
FIG. 1 is a schematic side elevational view of a shaft regrinding machine with the grinding gage in position.

In accordance with the present invention, there is shown in FIG. 1 the provision of a grinding gage 10 between the stationary base 12 and the movable support 14 for the grinding wheel 16 forming the headstock of the grinder. The indicator dial 18 of the grinding gage is positioned such that a person operating the machine can easily recognize its readings. The shaft to be ground down is indicated at 20. R shows what kind of radius can be used in connection with the grinder indicated in FIG. 1. The parts of the grinding gage are shown in FIG. 1 only schematically: a motion transmitting rod 22, an angle transfer lever 24 and a block 26 mounted to the base 12.

Figure 2:
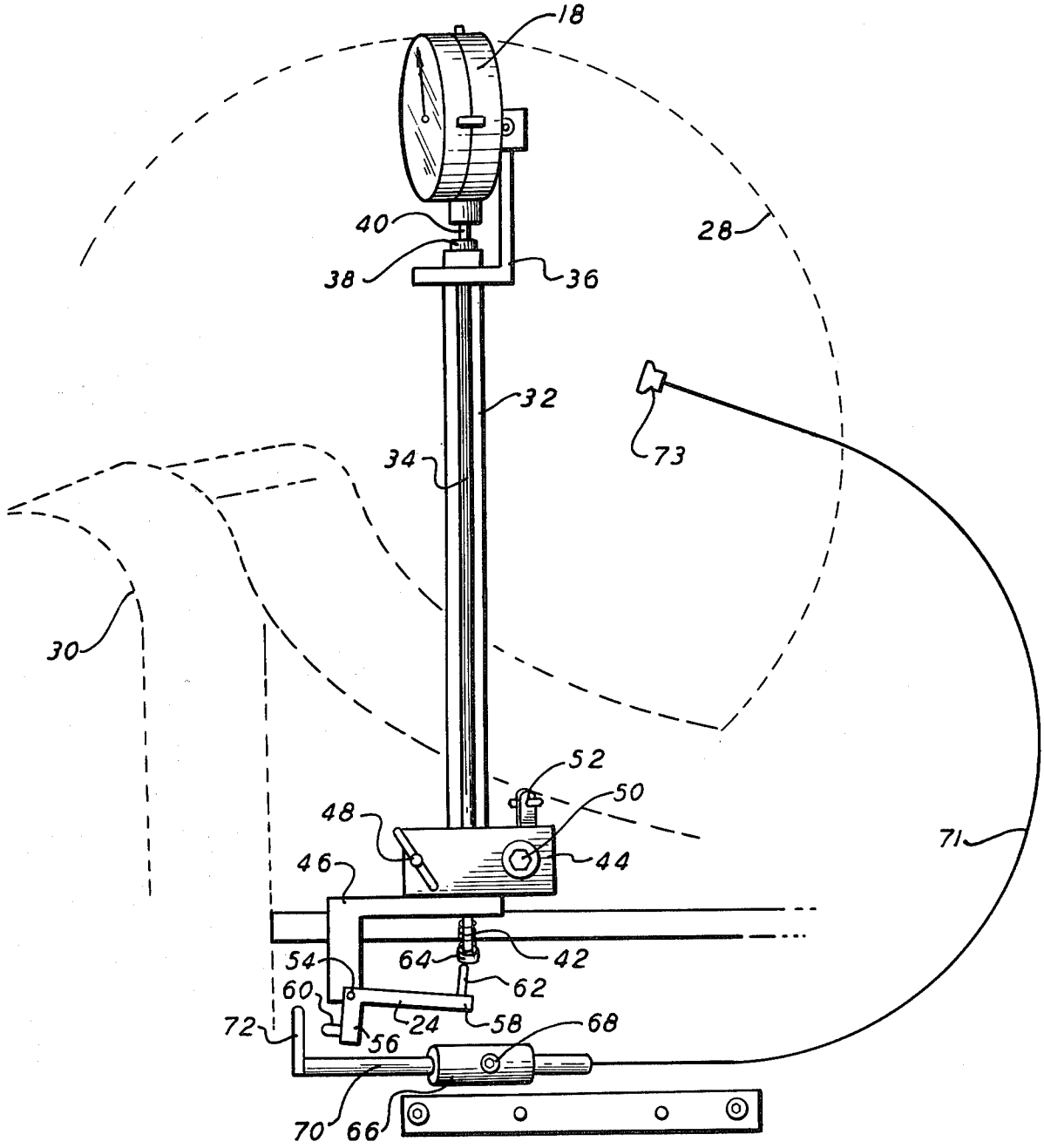
FIG. 2 is a schematic view of an embodiment of the grinding gage.

FIG. 2 shows in more detail the contruction of the gage. The dashed lines in the background indicate parts of the headstock such as the grinding wheel housing 28 and the belts 30 for the grinding wheel. The dial gage 18 can be a conventional dial gage. Preferably, the gage has graduations of one tenthousandth of an inch and a revolution of the dial hand can correspond to 20 thousandth of an inch. The total travel of a gage useful in crankshaft grinding can be about one quarter of an inch or about 1 centimeter. The gage is mounted on a holder 32 for a motion transmitting rod 34 by way of a bracket 36 such that the upper end 38 of the motion transmitting rod engages the measuring pin of the dial indicator 18. A helical compression spring 42 is provided to maintain the motion transmitting rod in spring contact with the measuring pin 40 during measurement. The holder 34 is attached by way of bracket 44 with fasteners 48, 50, 52 to the movable support 14 of the grinding wheel. A bracket 46 is also attached to the headstock directly or indirectly via the bracket 44. The bracket 46 carries the angle transfer lever 24 via a hinge 54. The angle transfer lever comprises a first arm 56 with a contact pin 60 and a second arm 58 with a contact pin 62 to engage the motion transmitting rod 32 at its lower end 64. The first arm 56 and pin 60 of the angle transfer lever 26 engages a block attached to the base of the grinder.

FIG. 2 shows an embodiment of the block where there is provided a holder 66 attached to the base. A shaft 70 passes through the holder 66 and is kept in position by a set screw 68 screwed into the holder 66. Alternatively, a cable 71 with an actuating element 73 shown only schematically here can be associated with the rod 70 for adjusting its position. A plate 72 attached to the shaft 70 provides the contact to the pin 60 of the first arm 56 of the angle transfer lever 24. The length of the first arm 56 of the angle transfer lever 24 is half the length of the second arm 58 of the angle transfer lever. Thus a motion of a certain distance by the headstock results in a twice the length motion of the motion transmitting rod and this allows to read directly diameter changes on the shaft to be ground rather than changes in radius with commercially available indicator dials.

Figure 3:
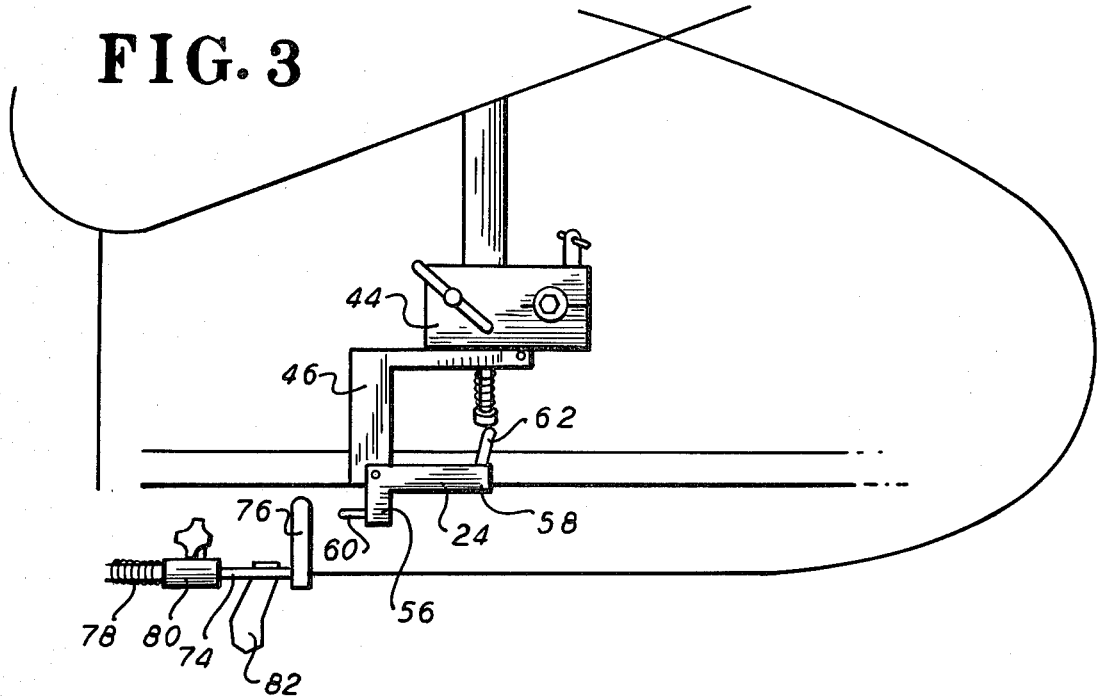
FIG. 3 is a detail view of the angle transfer lever as it relates to the the contact points of its arms.

FIG. 3 shows a further embodiment of the invention where the block attached to the base 12 is different. A shaft 74 with an end plate 76 engages the pin 60 of the first arm 56 of the angle transfer lever 26. The position of the shaft 74 relative to the base 12 can be adjusted with a Bowden cable 78 attached to a holder 80. An arm 82 can provide a limit to the possible adjustments of the positions of plate 76.

Figure 4:
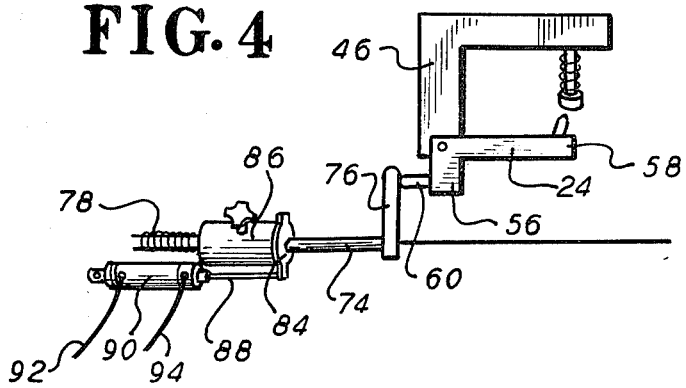
FIG. 4 is a schematic view of the setting adjustment with air cylinder.

FIG. 4 shows an additional embodiment of the invention where compressed air is employed to adjust the position of the shaft 74. A disk 84 is provided surrounding the shaft 74 for possible contact with the holder 86 here solidly attached to the shaft 74. The position of the disk 84 can be adjusted by an shaft 88 connected to an air cylinder 90, which can be actuated by compressed air fed in via conduits 92 and 94. Thus it is possible to control the position of the block versus the first arm 56 remotely by actuating an air valve (not shown). In addition, a microswitch can be provided at the block 26 or to the angle transmitting lever 24 so that when the unit is backed off and the headstock is brought back to the crank or the journal, it will put a light on when one comes for example within 25 thousandths of an inch of the crank shaft or the journal. Thus one can watch the gage for fast travel of the grinding wheel back and forth.

The grinding gage operates as follows: As the moving support moves toward the shaft to be ground, the block 26 moves toward the angle transfer lever 24 and turns the same around the hinge 54. The turning angle transfer lever 24 then moves the motion transmitting rod 34 upward toward the dial indiactor and this motion is transferred to the measuring pin of the dial indicator and then displayed by the dial indicator. Depending on the length of the arms of the angle transfer lever it is possible to obtain readings in the units desired.

It will be understood that each of the elements described above, or two or more together, may also find a useful application in other types of system configurations and grinding procedures different from the types described above.

While the invention has been illustrated and described as embodied in the context of a grinding gage for a crankshaft grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A grinding gage assembly for grinding of shafts at machines providing a stationary support of the axis for the rotating shaft and a movable support for the rotating grinding wheel comprising a block attached to the stationary support of the axis;

an angle transfer lever having two arms running at about a 90 degree angle from a hinge axis disposed at the movable support and the end of one of the arms contacts the block in an about tangential direction relative to the hinge point and where the hinge axis is about vertical to the direction of motion of the movable support;

a motion transmitting rod disposed at the movable support in a vertical direction and contacting with one end in the moving longitudinal direction of the rod the second arm of the angle transfer lever in about tangential direction such that the angle transfer lever transmits any relative motion of the block onto the motion transmitting rod and;

a dial indicator engaging the second end of the motion transmitting rod to display the relative change in position of the motion transmitting rod.

2. The grinding gage assembly according to claim 1 further comprising a spring attached to the motion transmitting rod for pressing the rod's end firmly against the second arm of the angle transfer lever.

3. The grinding gage assembly according to claim 1 wherein the block comprises a shaft providing the contact to the arm of the angle transfer lever; and a support for setting the relative position of the shaft.

4. The grinding gage assembly according to claim 3 further comprising a set screw for fixing the position of the shaft.

5. The grinding gage assembly according to claim 3 further comprising a disk surrounding the shaft;

a stop attached to the shaft for limiting the movement of the shaft relative to the disk;

a compressed air supply;

an air cylinder attached to the stationary support, linked to the disk to provide adjustment of the disks position and having a connection to the compressed air supply.

6. The grinding gage assembly according to claim 3 further comprising a Bowden cable connected to the shaft for adjusting the position of the shaft.

7. The grinding gage assembly according to claim 3 further comprising a helical spring attached to the shaft for maintaining the same in position versus the one arm of the angle transfer lever.

8. The grinding gage assembly according to claim 3 further comprising a switch associated with the angle transfer lever for discontinuing the motion of the movable support.

9. The grinding gage assembly according to claim 3 wherein the second arm of the angle transfer lever has twice the length of the first arm.

10. A method for controlling the grinding of a shaft having a stationary rotation axis with a grinding wheel having a movable support comprising contacting a block attached to the stationary support for the stationary rotation axis with one arm of an angle transfer lever having its hinge axis attached to the movable support and said hinge axis being disposed vertical to the direction of motion of the movable support;

inducing a motion of the angle transfer lever by providing a motion of the movable support;

engaging a motion transmitting rod mounted on the movable support with a second arm of the angle transfer lever for transmitting the relative motion of the lever around the hinge induced by the motion of the movable support; and indicating the displacement caused by motion of the transmitting rod on an indicator dial.

11. The method for controlling the grinding of a shaft according to claim 10 further comprising adjusting the position of a part of the block to contact the one arm of the angle transfer lever.

12. The method for controlling the grinding of a shaft according to claim 11 further comprising setting the reference position of the dial indicator by adjusting the position of the part of the block contacting the angle transfer lever with an air pressure cylinder.

* * * * *